US005201469A

United States Patent [19]

Urschel

[11] Patent Number: 5,201,469

[45] Date of Patent: Apr. 13, 1993

[54] COMMINUTING MILL

[75] Inventor: Joe R. Urschel, Valparaiso, Ind.

[73] Assignee: Urschel Laboratories, Inc., Valparaiso, Ind.

[21] Appl. No.: 675,965

[22] Filed: Mar. 27, 1991

Related U.S. Application Data

[63] Continuation-in-part of Ser. No. 580,552, Sep. 11, 1990, abandoned.

[51] Int. Cl.[5] ..... B02C 13/18

[52] U.S. Cl. ..... 241/5; 241/86.1; 241/188.1; 241/275

[58] Field of Search ..... 241/275, 5, 86,1, 88.1, 241/95, 188.1

[56] References Cited

U.S. PATENT DOCUMENTS 3,000,579 9/1961 Bridgewater .
3,023,973 3/1962 Conley et al. .
3,058,679 10/1962 Adams .
3,251,389 5/1966 Urschel et al. .
3,251,557 5/1966 Urschel et al. .
3,474,974 10/1969 Wood .
3,608,598 9/1971 Urschel et al. .
3,888,426 6/1975 Urschel et al. .
4,621,775 11/1986 Abom et al. ..... 241/86.1
4,784,339 11/1988 Deffenbaugh .

*Primary Examiner*—Mark Rosenbaum
*Attorney, Agent, or Firm*—Bacon & Thomas

[57] ABSTRACT

A rotating mill for comminuting a product, such as a food product, is disclosed in which the shape and orientation of the impeller blades, as well as the increased peripheral speed of the impeller, produce a finely comminuted product that was heretofore only capable with a multi-stage production process. The impeller rotates within an annular array of knives and the product is fed into the center area of the impeller. Centrifugal force urges the product across the rotating impeller, and into contact with the impeller blades and the knife array. The impeller has a generally circular impeller body that is rotatable about a generally centrally located rotational axis and a plurality of impeller blades attached to the impeller body. Each of the impeller blades has a product directing surface that extends parallel to an axis extending in a generally chordal direction across the impeller body and a product impact surface.

18 Claims, 13 Drawing Sheets

FIG. 5
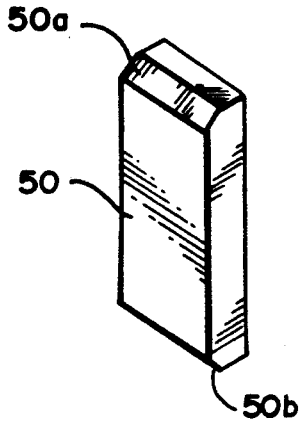
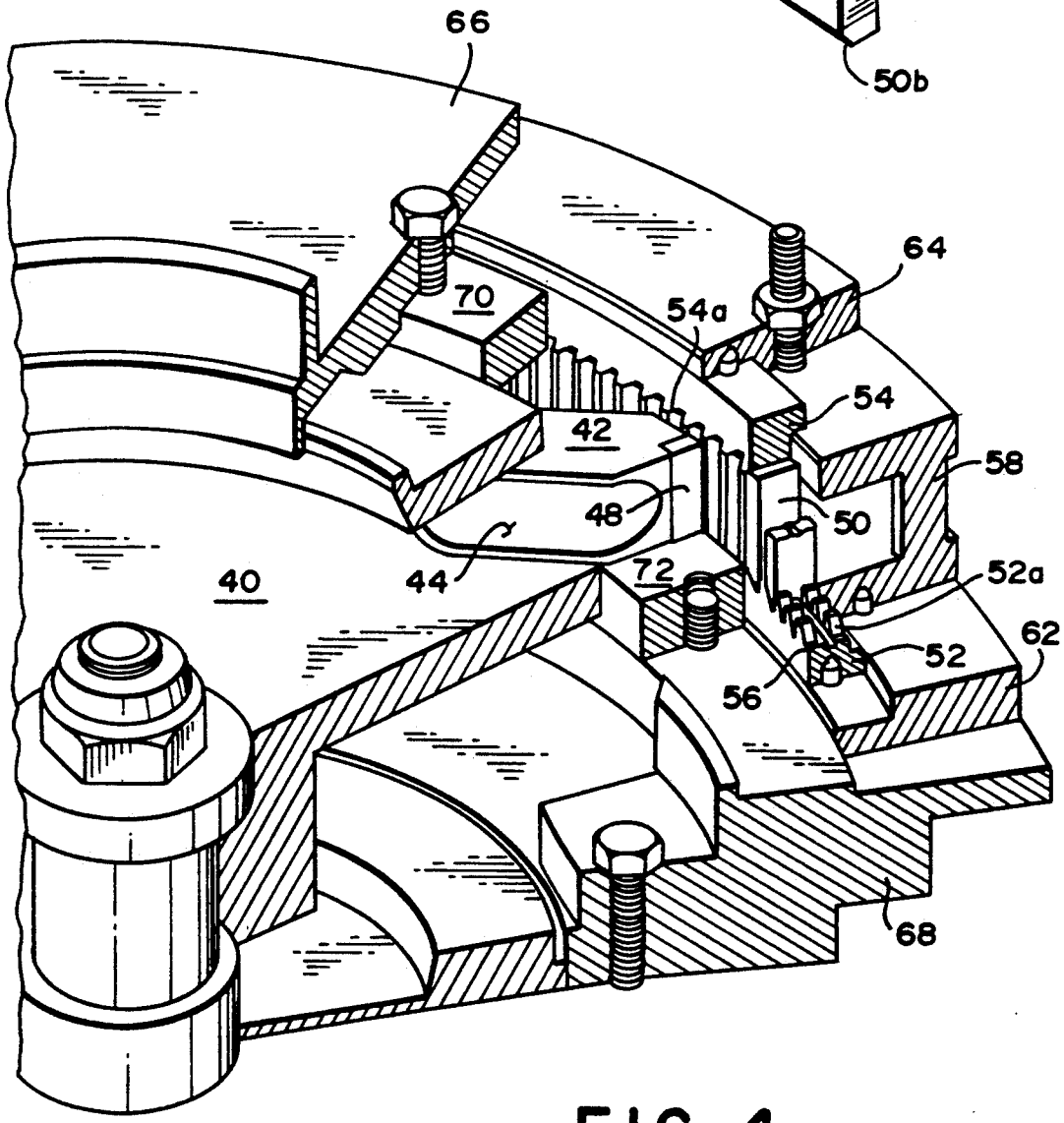
FIG. 4

FIG. 6
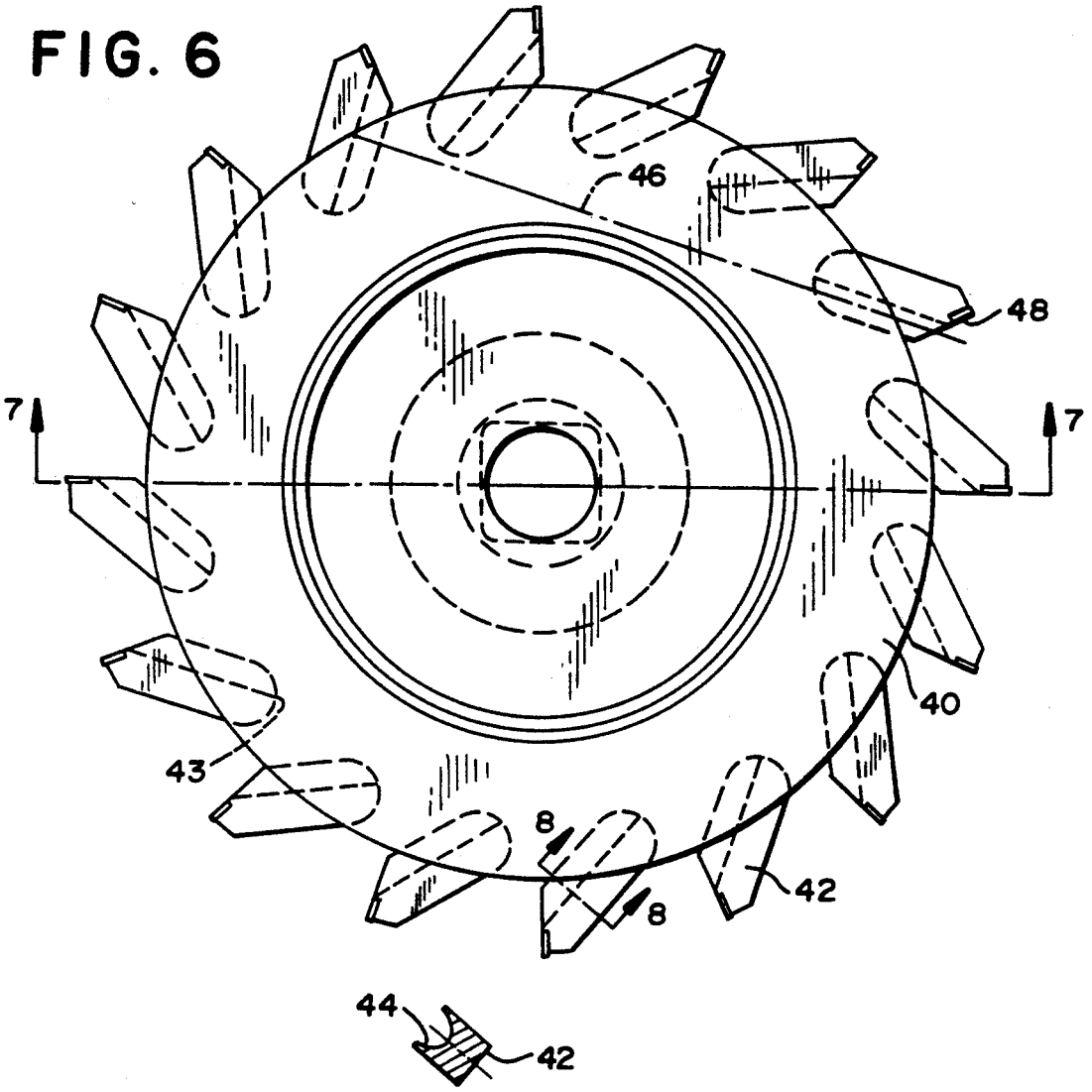
FIG. 8
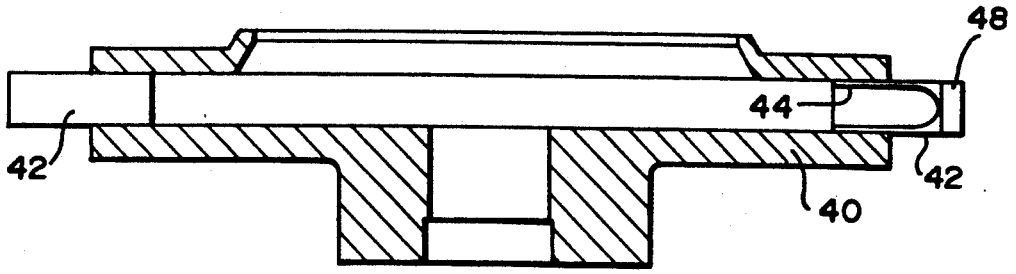
FIG. 7

COMMINUTING MILL

RELATED APPLICATION

This application is a continuation-in-part of U.S. Ser. No. 07/580,552 filed Sep. 11, 1990 now abandoned.

BACKGROUND OF THE INVENTION

The present invention relates to a mill for comminuting a food product.

Devices for comminuting a product, such as a food product, are well known in the art and typically comprise a rotating impeller having a plurality of generally radially extending blades disposed within a generally annular array of fixed, circumferentially spaced apart knives. During the past 25 years, these devices have been manufactured with an inside diameter of the annular knife array of approximately 6 inches. Although the impellers of these known devices may be operated at speeds up to 12,000 revolutions per minute, they are typically restricted to approximately 10,300 revolutions per minute to prolong the impeller bearing life. These devices have proven superior in their size reduction ability to any other commercially available equipment. Examples of such devices can be found in the following U.S. Pat. Nos. 3,251,389; 3,51,557; 3,608,598; and 3,888,426.

Recently, homogenizers have been introduced into the commercial arena that are capable, under some circumstances, of producing a comminuted product similar to that produced by the aforementioned mills. The homogenizers, which have found particular acceptance in the field of manufacturing peanut butter and ketchup, typically comprise a reciprocating piston moveable in an open ended cylinder. The open end of the cylinder is closed by a ball or plate that is tightly pressed against the end of the cylinder by a heavy spring. Movement of the piston away from the open end draws the product into the cylinder. Then, as the piston is advanced toward the open end, the pressure exerted on the product forces the ball or plate slightly away from the open end such that a thin stream of product is squirted out of the cylinder at a very high speed against a stationary surface. The destructive forces acting on the product rupture it into small particles. The homogenizers, while generally successful, require extensive, and therefore costly, maintenance and pose some danger to the operating personnel due to the high internal pressures applied to the homogenizer structure. Also, the product must first be reduced to a liquid before it can be pumped into the homogenizer.

In all of today's methods of making peanut butter, the roasted and de-skinned peanut halves are first converted into a hot liquid by passing them through a Bauer-type mill. The Bauer-type mill consists of two circular plates with the flat surfaces slightly separated and facing each other. These facing surfaces have bumps or protrusions that grind the peanuts when they are fed to the centers of the plates with one of the plates rotating at a high speed.

One of the present methods of making a high quality peanut butter is to pass the product from the Bauer-type mill through a series of rotating mills of the aforedescribed type. Passing the product through this plurality of rotating mills (typically two such mills are utilized) further reduces the sizes of the peanut particles. A swept wall heat exchanger is used between the two rotating mills to cool the peanut butter before it enters the second mill. It is also known to substitute the use of a homogenizer for the plurality of rotating mills to produce the final peanut butter product.

Tomato ketchup is made from ripe tomatoes after removing the skin, the seeds, and a portion of the water. Vinegar, sugar and spices are added to produce the flavor. The amount of insoluble material and its characteristics vary considerably with different batches of tomatoes. All ketchup manufacturers use some method to reduce the particle size of the insoluble material in the ketchup. Generally speaking, the smaller the particle size, the thicker will be the ketchup. The small particle size presents more surface area to collect the liquid, thereby increasing the viscosity of the product. At the present time, some manufacturers use rotating mills to produce their product, others use only homogenizers, while still others utilize a combination of the two devices.

The Bostwick test is a standardized test to determine the viscosity of a ketchup product. The test is made with a channel which is 5 cm wide by 3.8 cm in depth with the ends of the channel closed. A moveable gate is located across the channel at a distance of 5.2 cm from one end. The ketchup is poured into the box so as to be level with its top and the gate is raised to permit the ketchup to run lengthwise beyond the gate opening. The bottom of the channel is marked in centimeters and, after 30 seconds, the viscosity is determined by measuring the distance in centimeters the ketchup has moved into the channel. This distance represents the Bostwick number for any particular test.

SUMMARY OF THE INVENTION

A rotating mill for comminuting a product, such as a food product, is disclosed in which the shape and orientation of the impeller blades, as well as the increased peripheral speed of the impeller, produce a finely comminuted product that was heretofore only capable with a multi-stage production process.

The impeller rotates within an annular array of knives and the product is fed into the center area of the impeller. Initial contact with inner portions of the impeller blades breaks the product and urges it back toward the center of the impeller. Continued contact between the impeller blades and the product imparts rotation to the product. As the rotational speed of the product increases, centrifugal force urges it across product directing surfaces of the impeller blades and into the knife array. The product contacting the knives and passing between the knives is further comminuted by the process.

The increased peripheral speed of the impeller was achieved by enlarging the diameter of the impeller, thereby increasing the peripheral speed without requiring higher revolutions per minute, thereby preserving the impeller bearing life. Since the energy exerted on the product increases with the square of the relative peripheral speed, the energy generated on the product by this invention has markedly increased over the known devices, thereby resulting in a finer comminuted product using the same rotational speed of the impeller.

The impeller has a generally circular impeller body that is rotatable about a generally centrally located rotational axis and a plurality of impeller blades attached to the impeller body. Each of the impeller blades has a product directing surface, which may be concave and which extends along an axis extending in a generally chordal direction across the impeller body. As the product is fed onto the rotating impeller it initially contacts an inner portion of the rapidly moving impeller blades. Such contact breaks the product and, due to the orientation of the blades, urges the product toward the center of the impeller. The contact with the inner portions of the blades also imparts forward rotational movement to the product. Subsequent contact between the inner portions of the blades and the product increases the rotational speed of the product such that centrifugal force urges it radially outwardly and into contact with the product directing surfaces on the impeller blades. The concave product directing surfaces direct the food product towards the longitudinal center of the impeller blades to prevent any leakage of the product from the impeller wheel through the space between it and the knife array. When the product is forced off of the blades by centrifugal force, it contacts the center of a surrounding array of knives.

Each impeller blade defines a product impact surface on a generally radially inwardly facing portion which makes initial contact with the product as it passes radially outwardly over the impeller body. This initial contact contributes toward the partial size reduction of the product, imparts a forward speed to the product and also tends to deflect the product back toward the center of the impeller. This causes the product to be struck as many times as possible before it reaches sufficient rotational speed to move outwardly along the product directing surfaces of the impeller blades.

BRIEF DESCRIPTION OF THE DRAWINGS

FIG. 4 is a partial, perspective view, partially broken away, illustrating the impeller and the annular knife assembly according to the present invention.

FIG. 5 is a perspective view of one of the knives utilized in the annular knife array.

FIG. 6 is a plan view of the impeller according to the present invention.

FIG. 7 is a cross-sectional view of the impeller taken along line VII—VII in FIG. 6.

FIG. 8 is a cross-sectional view of one of the impeller blades taken along line VIII—VIII in FIG. 6.

DETAILED DESCRIPTION OF THE PREFERRED EMBODIMENTS

Figure 1:
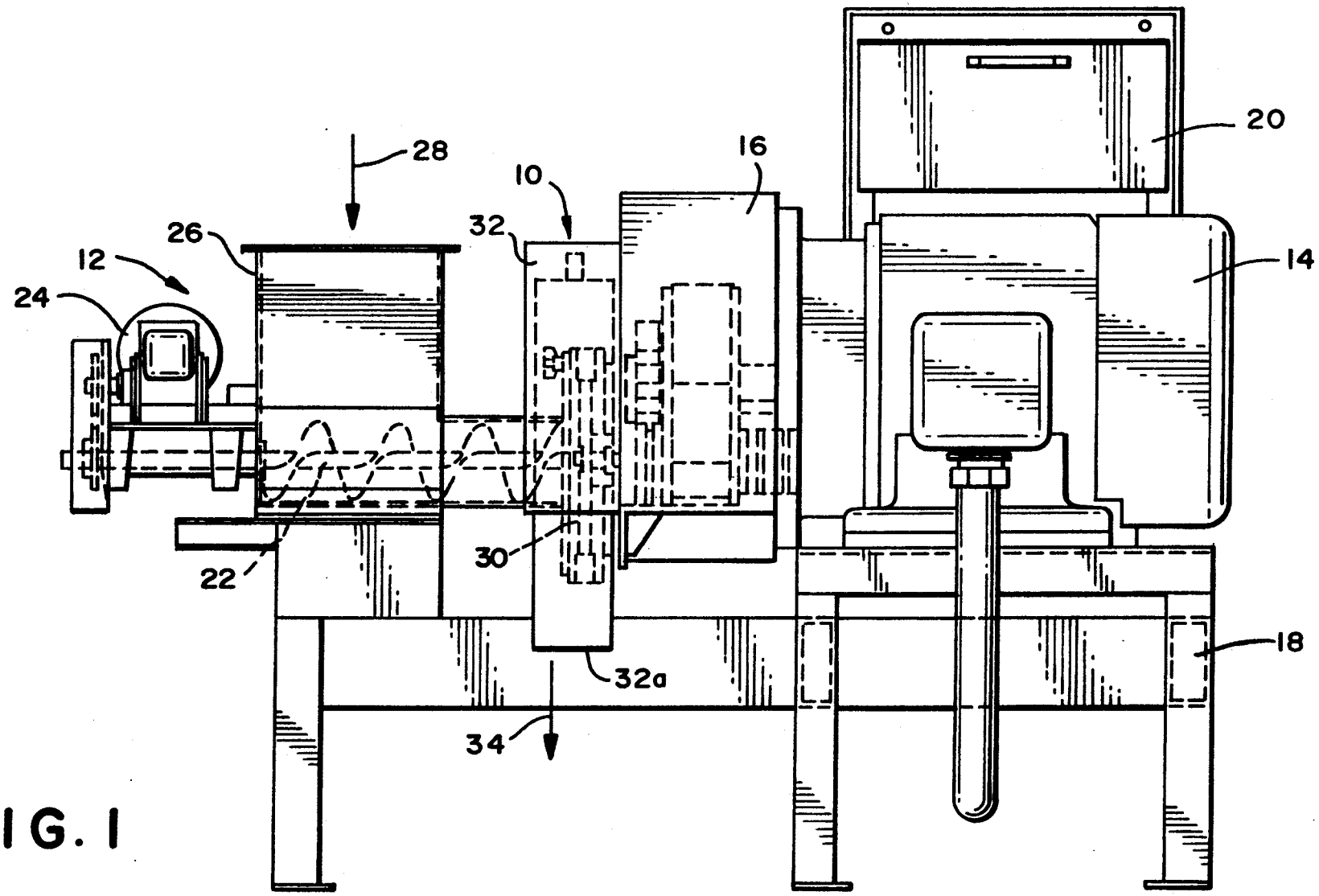
FIG. 1 is a front view of the comminuting mill according to the present invention.
Figure 2:
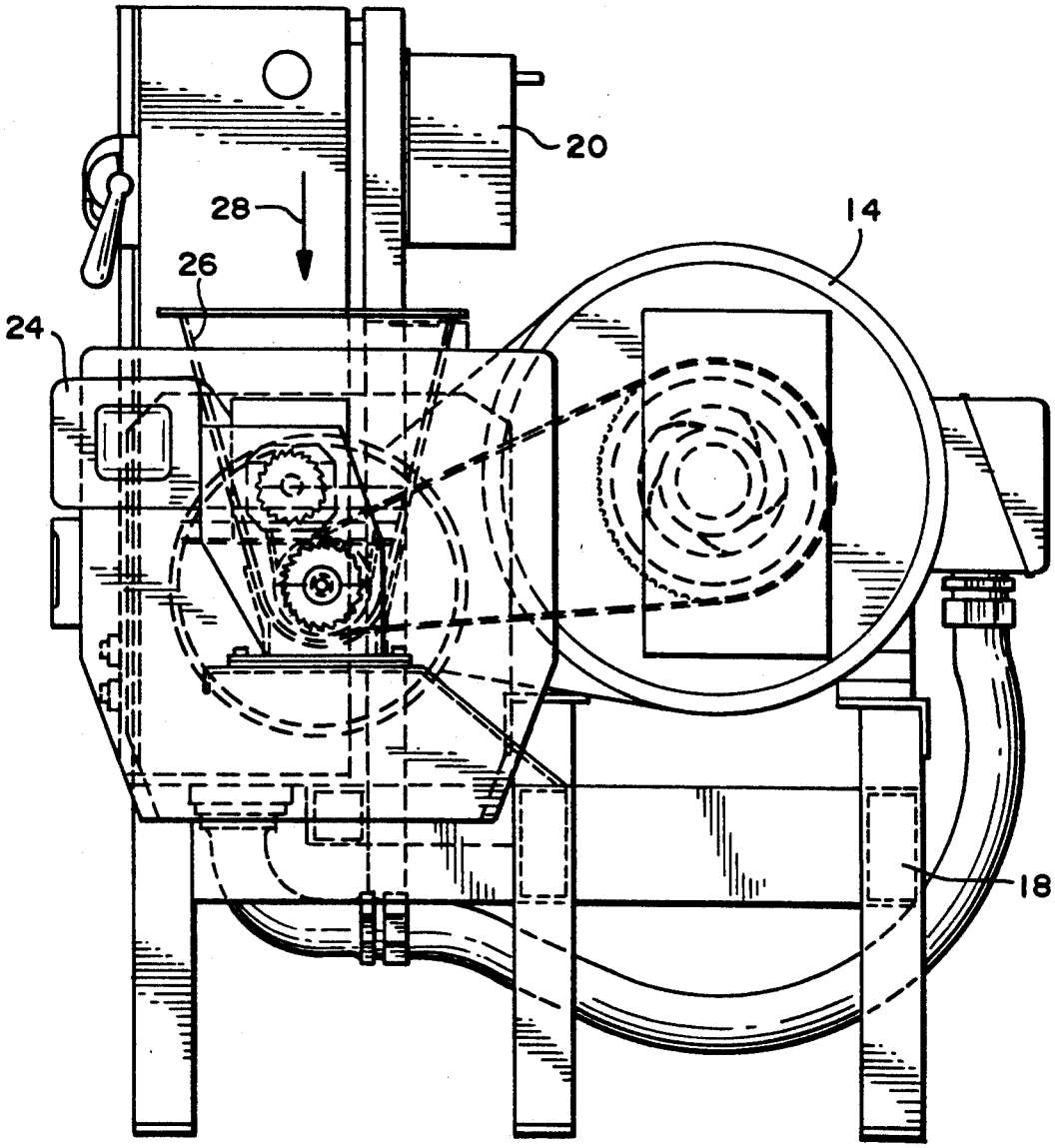
FIG. 2 is a side view of the mill shown in FIG. 1.

The comminuting apparatus according to the invention is shown in FIGS. 1 and 2 and generally comprises a comminuting mill structure 10, a feed mechanism 12 to feed the product into the comminuting mill 10 and an electric motor 14 to drive the impeller of the comminuting mill 10. A drive transfer mechanism 16, which may comprise drive belts or drive gears, may be interposed between the electric motor 14 and the impeller of the comminuting mill 10 to transfer the rotary motion from the motor output shaft to the impeller. These elements may be mounted on a base support 18, which may also support the control panel 20 containing the known elements to control the operations of the motor and/or the feed mechanism 12.

The feed mechanism 12 is illustrated as comprising a feed screw-type conveyor 22 actuated in known fashion by an interconnection with feed screw drive motor 24. Feed screw 22 contacts the product placed in hopper 26 and transfers it to the comminuting mill 10. Comminuting mill 10 is surrounded by a mill housing 32 having an open bottom portion **32*a*. Thus, in the comminuting operation, the product travels into hopper 26 in the direction of arrow 28, is transported to the comminuting mill 10 via screw conveyor 22 and the comminuted product exits through the bottom 32*a* of the mill housing 32 in the direction of arrow 34**.

Figure 3:
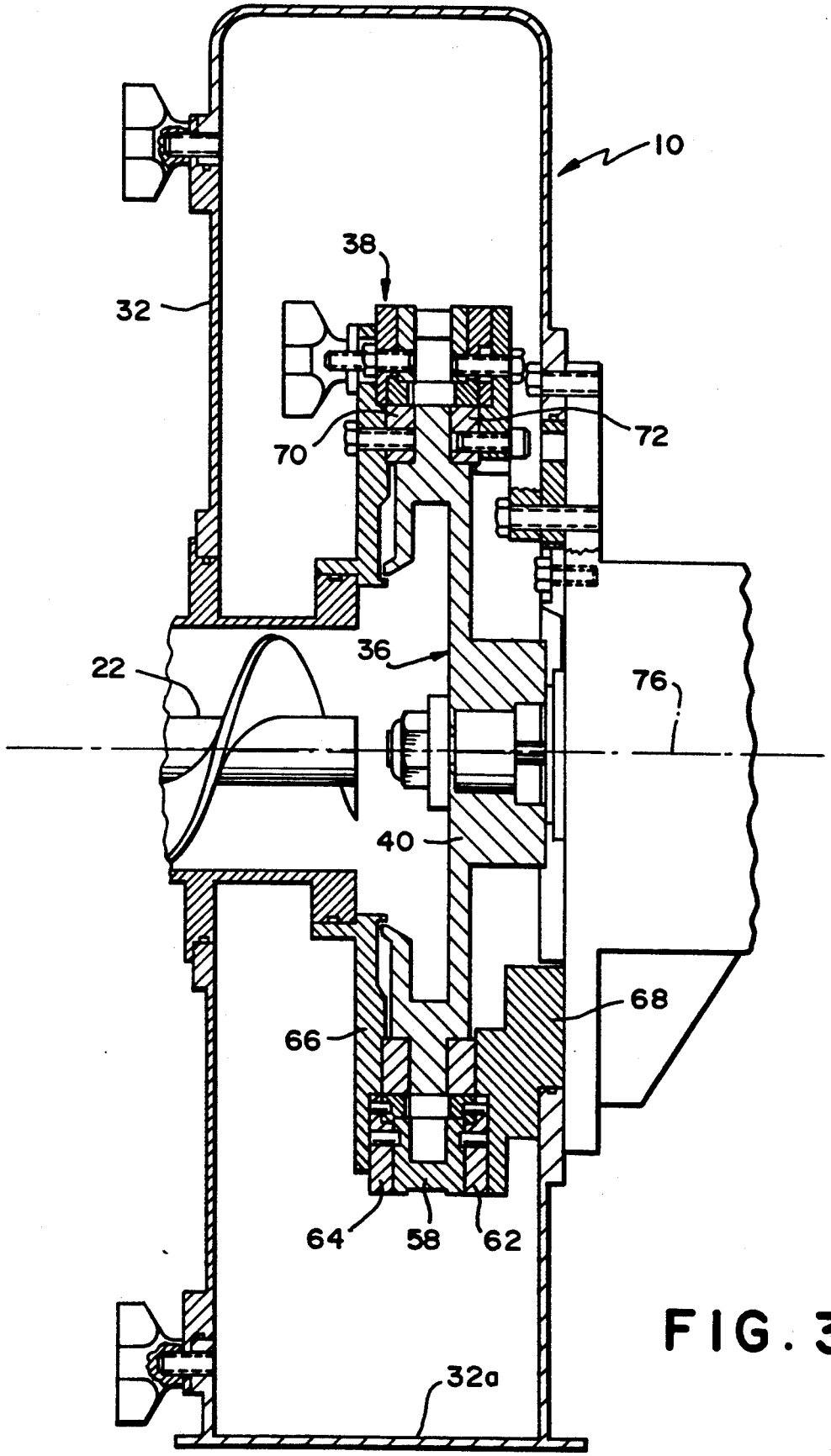
FIG. 3 is a partial, cross sectional view of the mill according to the present invention.

As best seen in FIGS. 3, 4 and 6, the comminuting mill 10 comprises an impeller 36 rotatably located within an annular knife assembly 38 so as to rotate about axis 76. The impeller 36 comprises an impeller body 40 having a plurality of impeller blades 42 attached thereto. Each of the impeller blades 42 has a product directing surface 44 extending along its length. The product directing surface 44 is a linear surface extending parallel to, and may be concavely curved about, a straight axis extending in a generally chordal direction across the impeller body 40, as illustrated in FIG. 6 by axis 46. In known fashion, a hardened metal tip element 48 may be attached to the radially outermost portion of each of the impeller blades.

The straight, chordal product directing surfaces 44 have been found to be a marked improvement over the curved leading surfaces of the impeller blades shown in U.S. Pat. No. 3,888,426. The curved leading blade surfaces cause the product to actually wear holes through the blade behind the blade tip. Straight surfaces 44 oriented in a generally chordal direction have been found to alleviate this problem and such blades have shown little wear after extensive use.

As can be seen from FIG. 6, the tip element 48, as well as the radially outermost forward portion of each blade 42, extends in a generally radial direction. Since the chordal product directing surface 44 extends at an angle to the radial blade tip portion, the product passing along surface 44 is suspended without touching any surface for an instant after leaving surface 44 before it is contacted by the associated blade tip. Once the blade tip contacts the product, it carries it in a rotational path over the knives.

The concave product directing surfaces 44 perform three basic functions: 1) their radially innermost portions direct part of the incoming product back toward the center of the impeller; 2) they convey the product past the point where it could ordinarily leak out of the assembly if the leading surface of the blade was flat; and, 3) they deposit the product in the middle of the knives.

Figure 9:
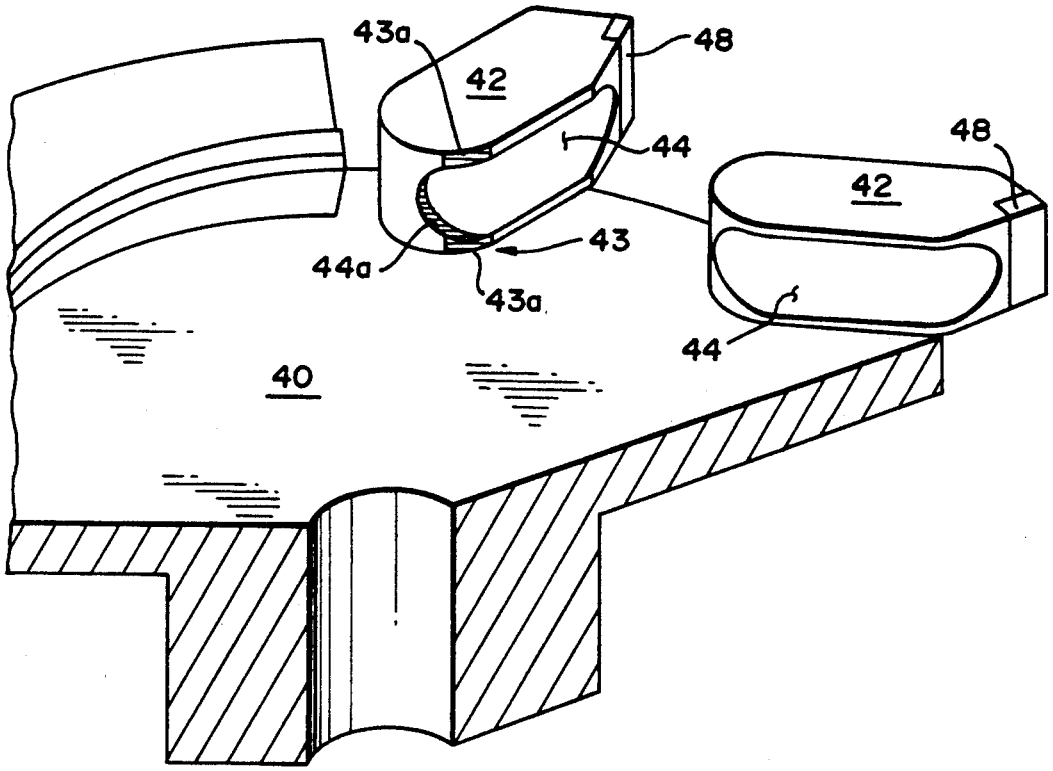
FIG. 9 is a partial, perspective view of the impeller illustrating the product impact surfaces.

A radially inner portion of each impeller blade 42 defines a product impact surface 43 illustrated by shading in FIG. 9. Surface 43 makes initial contact with the product as it passes radially outwardly over the impeller 40, which contact contributes toward the partial size reduction of the product. With sixteen blades on an impeller rotating at 9,300 revolutions per minute, the incoming product is struck by these surfaces at approximately 2,480 times per second. Product impact surfaces 43 impart a forward rotational speed to the product and also direct the product back toward the center of the impeller 40. When the product initially enters the impeller, it has only a very small rotational velocity. The rotational speed differential between the impeller blades and the product is so great that the product cannot enter between the impeller blades because they are moving past the product too rapidly.

Each contact between the product and the impact surfaces 43 imparts a greater rotational speed to the product. At some point, the rotational speed of the product becomes great enough that the centrifugal force acting on the product will force it between the impeller blades and into contact with the product directing surfaces 44. The product will then pass along surfaces 44 and into contact with knives 50.

As illustrated by the shaded portion in FIG. 9, product impact surfaces 43 comprise convex portions 43*a* on either side of product directing surface 44, as well as by a radially innermost portion 44*a* of concave surface 44. The orientation of surfaces 43*a* and 44*a* is such that they tend to deflect the product back toward the center of the impeller, thereby causing the product to be struck as many times as possible before it moves outward between the blades. Alternatively, the radially inner portions of impeller blade 42 may assume, but are not limited to, the configurations illustrated in FIGS. 17A–17E.

The annular knife assembly comprises, as best illustrated in FIGS. 3 and 4, a plurality of knives 50 supported in a spaced apart, annular array around the periphery of the impeller 36 by knife holding rings 52 and 54. The edges of the knives 50 may be beveled, as at 50*a* and 50*b* in FIG. 5, so as to engage correspondingly angled surfaces 52*a* and 54*a* formed on knife holding rings 52 and 54, respectively. A resilient ring 56 extends circumferentially around the knife holding ring 52 so as to resiliently bear against an end of each of the knives 50. The blades are prevented from moving radially outwardly by contact with the legs of knife locating ring 58. Ring 58 is attached to knife supporting rings 62 and 64, to which are also mounted knife holding rings 52 and 54. A cover plate 66 may be attached to knife support ring 64, while knife support ring 62 is fixedly attached to locating plate 68. Inner knife locating rings 70 and 72 are attached to cover plate 66 and locating plate 68, respectively, and are located on either side of the impeller blades 42. These elements prevent the radially inward movement of any of the knives 50 and also define a pocket-like cavity in which the outwardly projecting portions of the impeller blades 42 travel.

The mounting and support structure for the knives 50, as well as the mechanism by which the product is comminuted by passing radially outwardly over the rotating impeller, into contact with and through the spaces between the knives 50 is set forth in U.S. Pat. Nos. 3,251,389; 3,251,557; 3,608,598; and 3,888,426, each of which is incorporated herein by reference.

Figure 10:
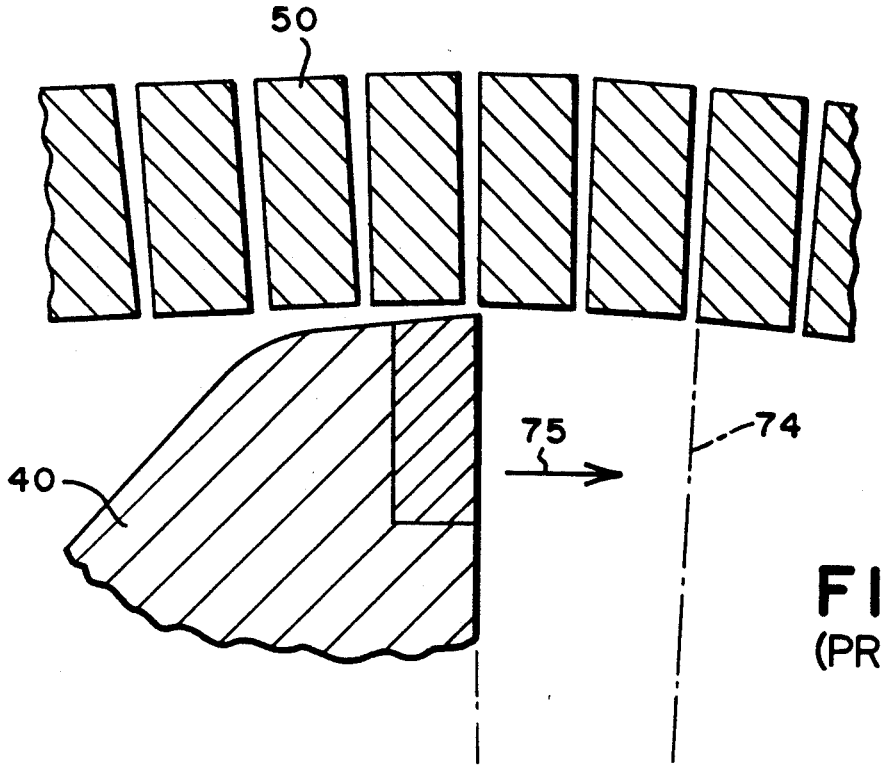
FIG. 10 (PRIOR ART)
FIGS. 10–13 are partial views of an impeller blade tip and the knife array illustrating the known orientations of the knives in the array.

The knife orientations disclosed in the aforementioned patents are illustrated in FIGS. 10, 11, 12 and 13. As illustrated in FIG. 10, each of the individual knives 50 may be oriented such that their upstream side (measured in relation to the direction of travel of blade 40, indicated by arrow 75) lies along a radius 74 passing through the rotational axis 76 of the impeller 40. Thus, the trailing edge of each knife lies at a greater radius than the leading edge of the adjacent knife.

Figure 11:
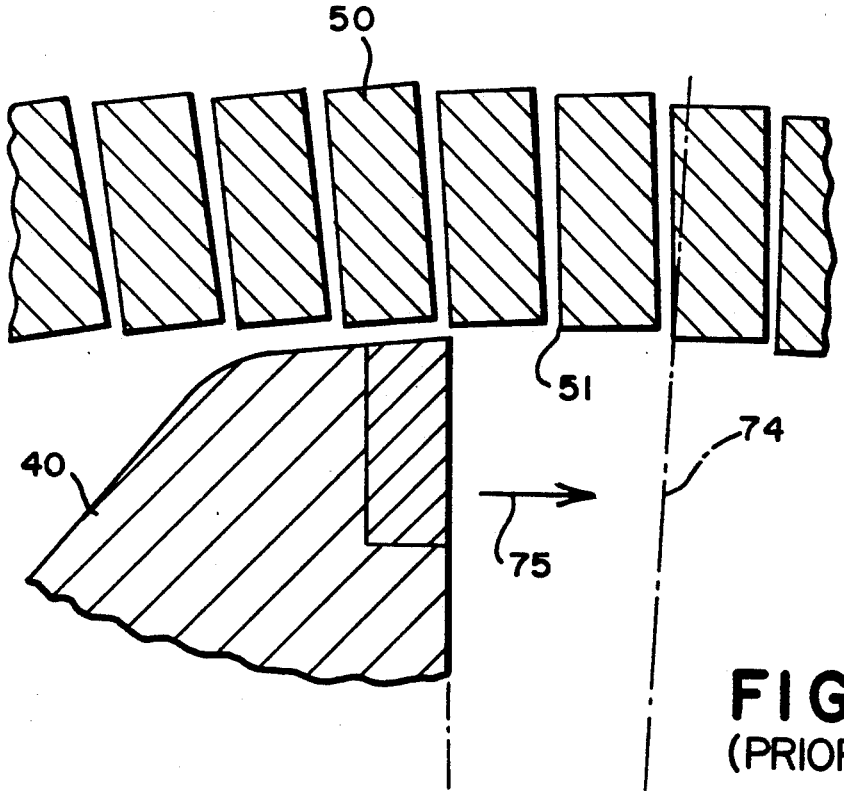
FIG. 11 (PRIOR ART)
Figure 12:
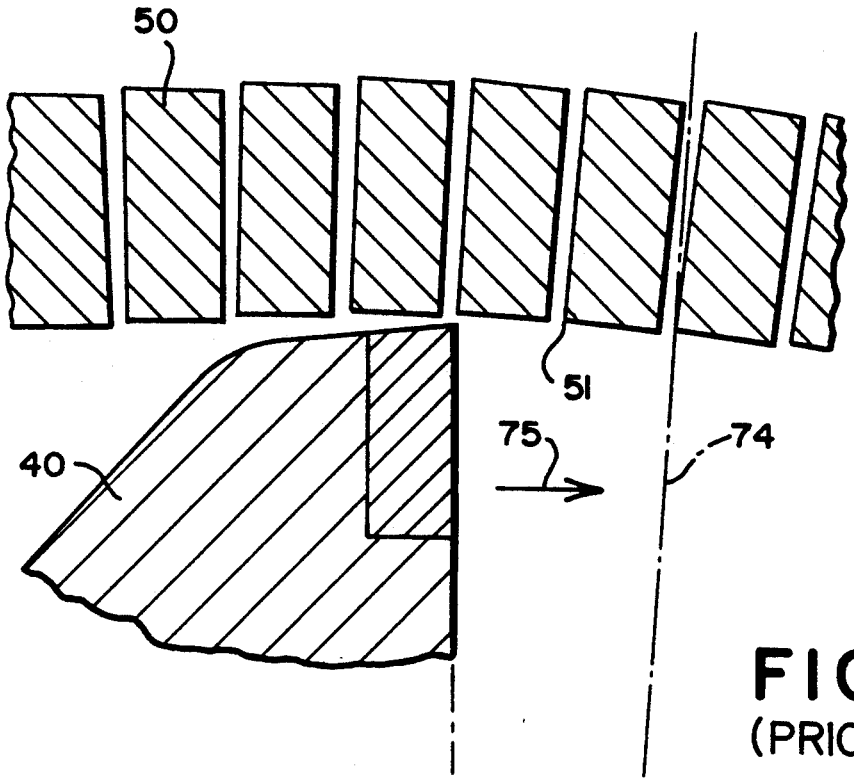
FIG. 12 (PRIOR ART)
Figure 13:
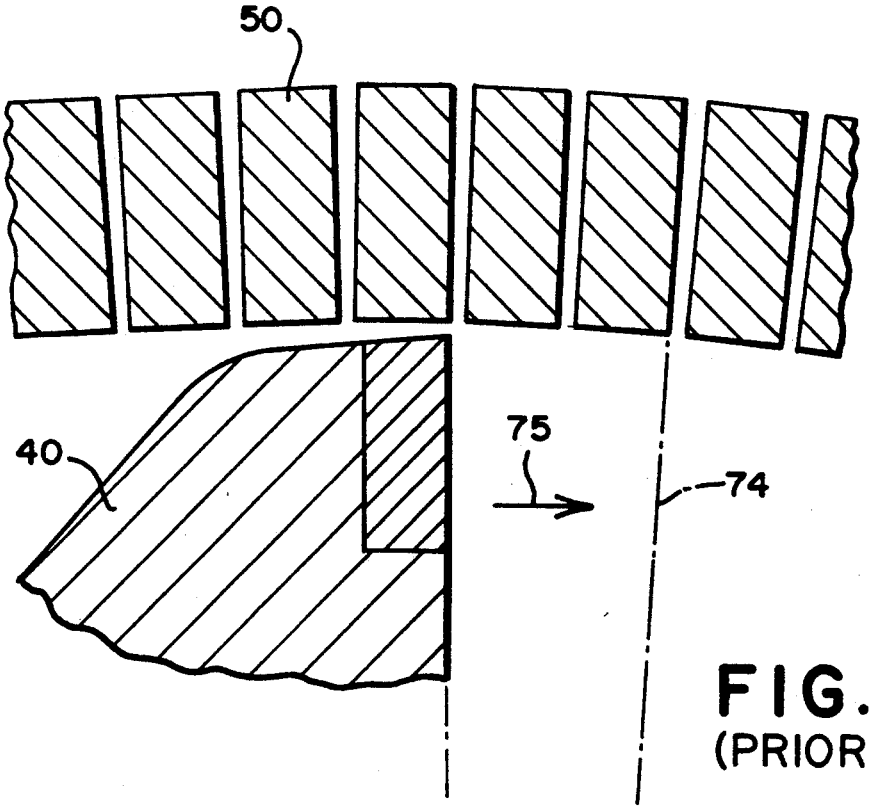
FIG. 13 (PRIOR ART)

As variations on this general orientation, and as illustrated in FIGS. 11 and 12, the knives can be tilted about their upstream, radially innermost cutting edges 51 in either direction. Finally, in another known knife orientation, each of the downstream surfaces can be oriented in alignment with a radius line 74 as illustrated in FIG. 13.

Figure 14:
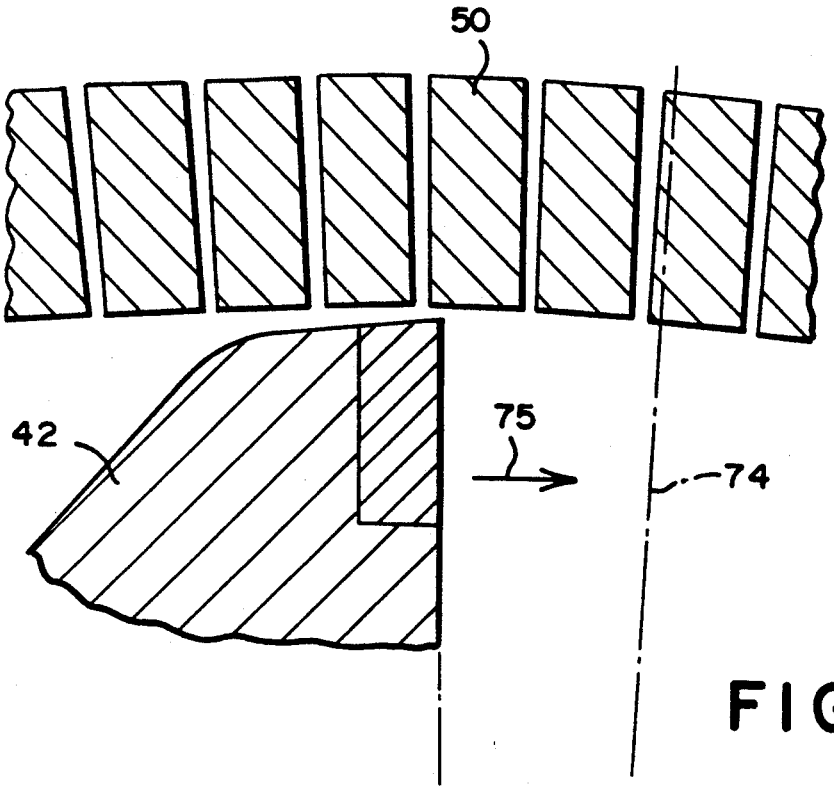
FIG. 14 is a partial, schematic view illustrating the impeller blade tip and the knives showing a first embodiment of the knife orientation according to the present invention.
Figure 15:
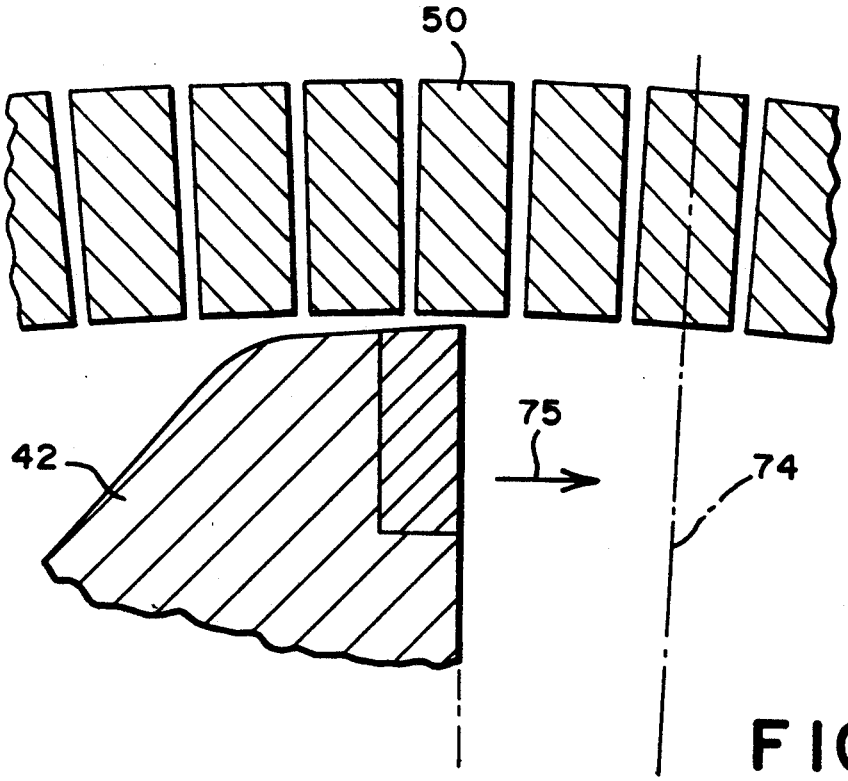
FIG. 15 is a view, similar to that shown in FIG. 14, illustrating a second embodiment of the orientation of the knives in the annular array.

It has been found that the knife orientations shown in FIGS. 14 and 15 can be used with the comminuting mill according this invention to produce a more finely comminuted product than was possible with the known devices. While any of the known knife orientations can be used with the mill according to this invention, those orientations shown in FIGS. 14 and 15 have proven particularly suitable. In FIG. 14, the knives 50 are each oriented such that their upstream surface extends generally parallel to a radius line 74, but the radius line 74 is displaced toward the downstream surface a small distance from the upstream surface. The trailing or downstream edge of each knife lies at a greater radius than the leading edge of the adjacent knife.

In FIG. 15, the radius line 74 passes approximately through the center of the knives 50 such that it lies in a plane passing through the center of the knife. In this instance, the trailing or downstream edge of each knife is at approximately the same radius at the leading or upstream edge of the adjacent knife. The centrifugal force exerted on the product by the blades causes a portion of the product to be extruded into the space between the knives. This portion is subsequently sheared off and forced between the knives by the blade tip.

Depending upon the specific product to be comminuted, the circumferential spacing between each of the individual knives 50 may be varied to produce the desired end product. The degree of size reduction, with any particular knife configuration, is controlled by the number of knives in a particular assembly. In general, the greater the number of knives, the greater will be the size reduction.

The knife orientation shown in FIG. 14, when used in conjunction with the mill according to the present invention, has been found to be particularly effective in making peanut butter. A single mill according to this invention, in one test, produced a superior quality peanut butter at approximately 11,000 pounds per hour using 175 horsepower. This single comminuting mill thus replaces the two Bauer-type mills (using 75 horsepower each), and 4 rotating comminuting mills (each using 40 horsepower each, 6 motor driven pumps and 1 swept wall heat exchanger. Use of this mill quite obviously saves vast amounts of energy, as well as producing a superior quality product in a single-step operation.

TABLE I

| Test Number | 1 | 2 | 3 | 4 |
|---|---|---|---|---|
| Inside Diameter of Knife Assembly In Inches | 12 | 12 | 12 | 6 |
| Revolutions per Minute | 4,400 | 6,400 | 9,400 | 8,800 |
| Peripheral Speed in Feet per Second | 230 | 335 | 492 | 230 |
| Depth of Cut in Inches | .0062 | .0062 | .0062 | .0059 |
| Space Between Blades in Inches | .0236 | .0236 | .0236 | .0270 |
| Volume under 31 Microns, .0012 Inches | 77.7% | 81.8% | 90.5% | 76.5% |
| Volume over 88 Microns, .0035 Inches | 5.9% | 2.4% | 0.0% | 5.5% |
| Volume over 176 Microns, .0069 Inches | 2.8% | 0.0 | 0.0 | 2.1% |
| Mean Value in Microns | 27.17 | 20.64 | 14.66 | 26.89 |

Test results of the mill according to the present invention in comparison with a known rotary mill are noted in Table I above. These tests were conducted by milling half peanuts in a single pass. Tests 1–3 were conducted with the rotating mill according to this invention, while Test 4 utilized a known rotary mill having a diameter of 6 inches across the innermost ends of the knives.

The test results illustrate the effect of changing the peripheral speed of the impeller and, consequently, the speed of the peanuts over the knives, on the quality of the resulting peanut butter product. In Tests 1, 2 and 3, the mill according to this present invention, which has a diameter inside the knife assembly of 12 inches, was tested at varying impeller speeds. As the impeller speed was increased from 4,400 revolutions per minute (Test 1) to 9,400 revolutions per minute (Test 3), the very small particles increased in volume from 77.7% to 90.5%. The number of particles larger than 88 microns decreased from 5.9% in Test 1 to 0% in Test 3. Peanut butter made in Test 3 would be considered to be the highest quality, while that made in Test 1 would be of poor quality.

Test 4 was made with a 6 inch diameter knife assembly, but having a similar depth of cut and circumferential spacing between the knives to the mill in Test 1. The mill in Test 4 utilized a rotational speed of 8,800 revolutions per minute. The peripheral speed of the impeller blade tips is approximately the same for Tests 4 and 1 and the resulting product has approximately similar characteristics. Thus, these tests are indicative that the peripheral speed of the impeller blade tips and, consequently, the peripheral speed of the product over the knives produces the unexpected results, which are not the result of merely increasing the diameter of the impeller.

Tests have also proven that the present invention improves the viscosity over the known mill types. Tests were made by passing ketchup having a Bostwick number of 9.5 through a known comminuting mill with a 6" diameter and through a mill according to the present invention having a 12" diameter. After a single pass, the 6" mill improved the viscosity of the ketchup to a Bostwick number of 6.9, while the mill according to the present invention improved the viscosity to a Bostwick number of 3.6. It is believed that the 3.6 viscosity is equal to or better than that produced by known homogenizers.

By using a 12" inside diameter knife array with an impeller rotating at a speed of 9,300 RPM, the product moves over the knives at 487 feet per second or 332 miles per hour and is pressed against the knives at 14,747 times it own weight.

Tests using high speed photography were conducted using the present invention to mill half roasted peanuts. It was observed that the peanut halves were reduced to butter by the time the product had reached the knives. It was also observed that the product directing surfaces 44 caused the peanut butter to be laid down in a narrow ribbon in the middle of the knives.

As a result of the observances, additional tests were conducted without the knife array. The peanut halves were directed onto the 12" impeller rotating at 9,300 RPM and were discharged against housing 32. The product resulting from the test was peanut butter. This clearly demonstrates that the instant invention performs a two-stage operation, with the action of the impeller blades impacting on the product as a first stage size reduction and the action of the knife array a second stage size reduction.

Analysis of the peanut butter produced using only the impeller indicated that 59.5% of the particles were under 31 microns, 9.9% were over 88 microns and the mean value of particle size was 37.48 microns.

The mill according to the present invention also reduces the unwanted heat and the excessive power that is caused by friction between the fast moving product and the stationary knife assembly. As the product moves radially outwardly on the impeller, it reaches the limit of the impeller, at which time it is discharged into a relatively deep pocket defined between the inner knife locating rings 70 and 72, and the faces of the knives 50. The concave product directing surfaces 44, formed in each of the impeller blades 42, causes the product to be deposited generally in the middle of the knives 50 to greatly reduce the friction between the fast moving product and the stationary faces of rings 70 and 72. The stationary rings 70 and 72 are necessary to prevent the product from escaping between the outer limits of the impeller and the inner surfaces of the knife array without it coming in contact with the knives 50.

The knife orientation illustrated in FIG. 15 has, in preliminary, tests, proven to be of great benefit in making a high quality tomato ketchup. In controlled tests, the knife orientation shown in FIG. 15 was compared with that illustrated in FIG. 13 with the result that the power requirements were decreased by approximately 23.7% without a change in the viscosity of the product.

Figure 16:
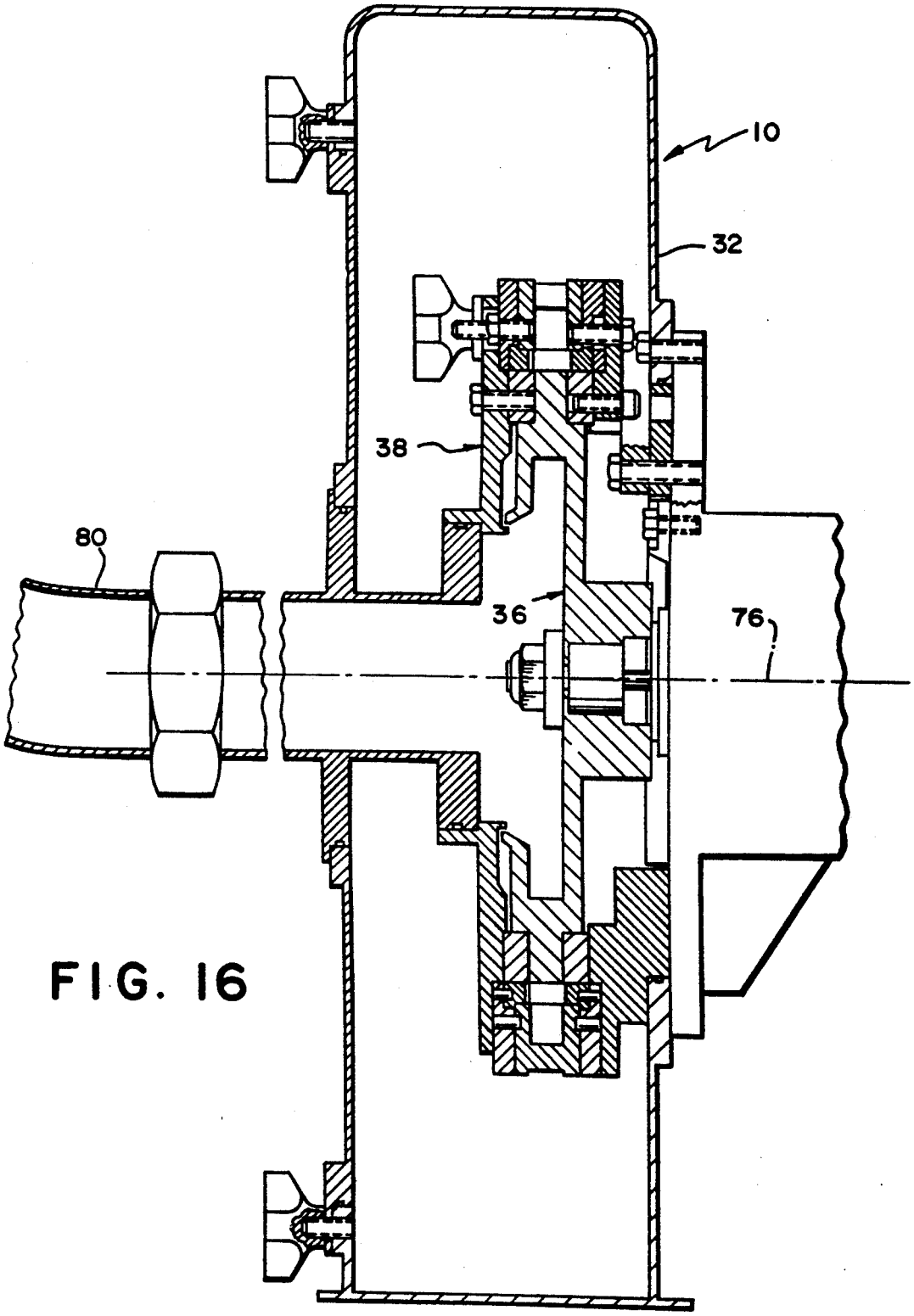
FIG. 16 is a sectional view, similar to FIG. 3, illustrating an alternative product feed mechanism.
Figure 17A:
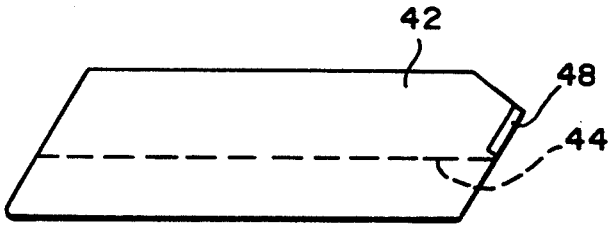
FIGS. 17A–17E are plan views of impeller blades showing alternative variations of the blade design.
Figure 17B:
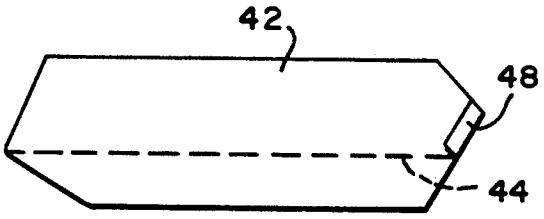
Figure 17C:
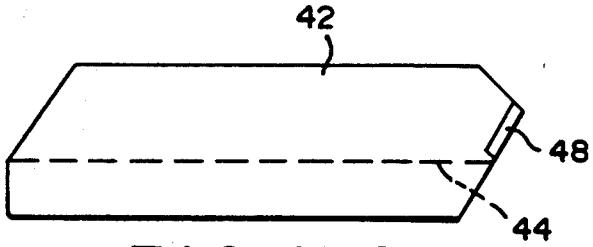
Figure 17D:
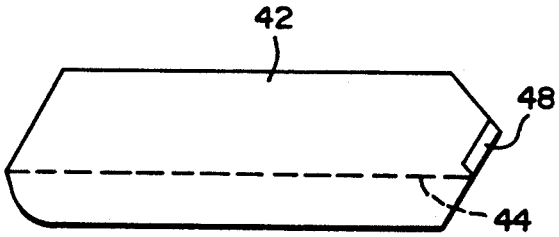
Figure 17E:
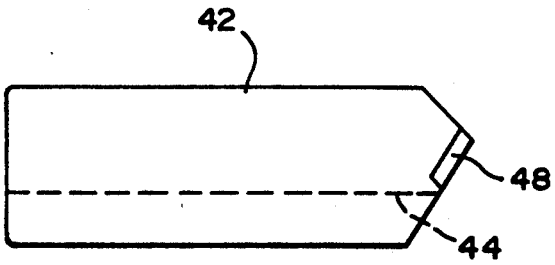

The comminuting mill according to the invention may be used with a variety of feed mechanisms. Although a screw-type conveyor 22 has been described, if the feed product is fluid, it may be pumped by known pumping devices onto the impeller 40 through feed input conduit 80, as illustrated in FIG. 16. The structure and operating characteristics of the mill shown in FIG. 16 are the same as the previously described mill.

Although the comminuting mill according to the invention has proven remarkably successful, it has been noted that, under certain circumstances, the product being size reduced may be compacted in the spaces between the individual knives. When this compacting occurs, additional pressure must be produced on the inner side of the knives to force the material through and out of the spaces between the knives. It is sometimes necessary to build up a product layer inside the inner knife surfaces in order to generate sufficient centrigugal force to cause the product to exit between the knives. This results in excessive power requirements with a corresponding and undesired increase in the temperature of the product.

The milling of certain kinds of materials with the comminuting mill may cause the product to be compacted between the knives to the extent that more material cannot be milled.

Figure 18:
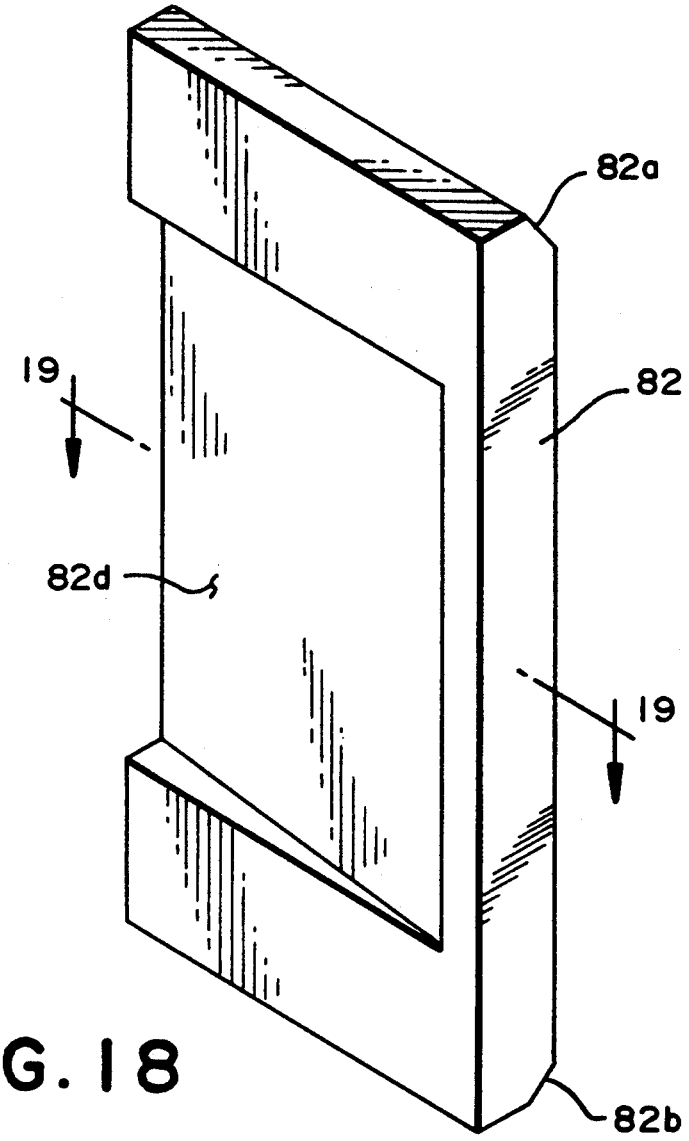
FIG. 18 is a perspective view of an alternate embodiment of a knife utilized in the annular knife array.
Figure 19:
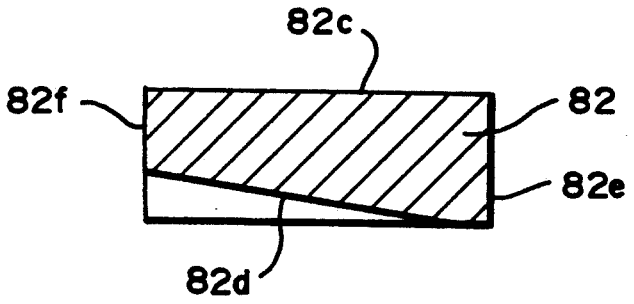
FIG. 19 is a cross-sectional view taken along lines XIX—XIX in FIG. 18.

FIGS. 18 and 19 illustrate an alternative embodiment of a knife design intended to alleviate these problems. The knife 82 may have beveled edges 82*a* and 82*b*, as well as a first side surface 82*c* and a second side surface 82*d* that extends non-parallel to the first side surface. The side surface 82*d* is angled such that the inner surface 82*e* has a width greater than that of an outer surface 82*f*.

Figure 20:
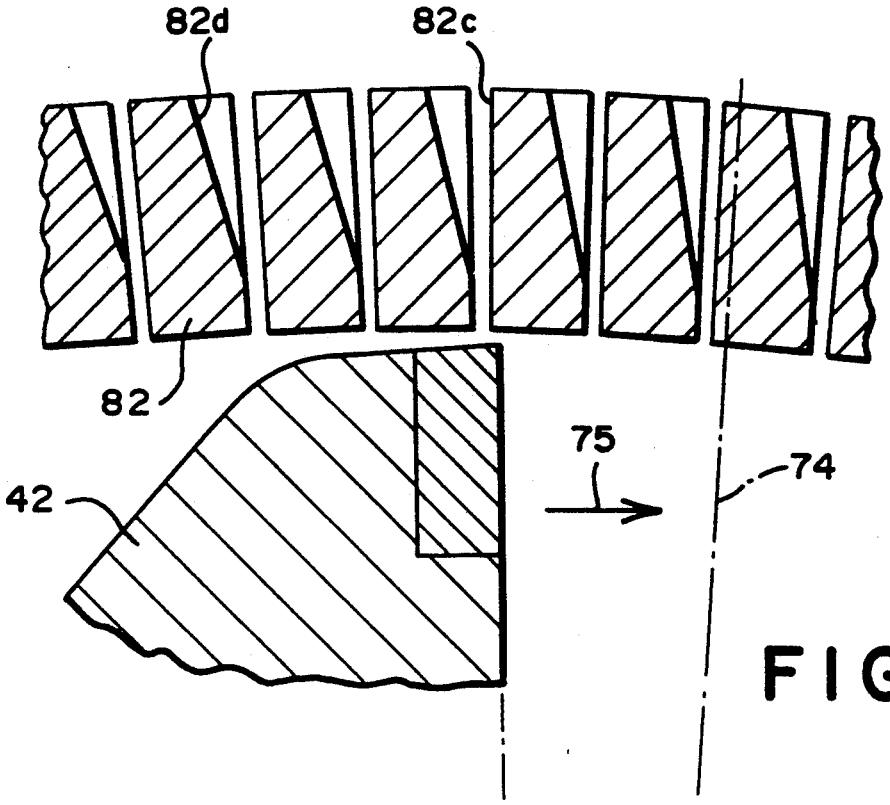
FIG. 20 is a partial schematic view illustrating the impeller blade tip and the knives of FIG. 18 in a first orientation.
Figure 21:
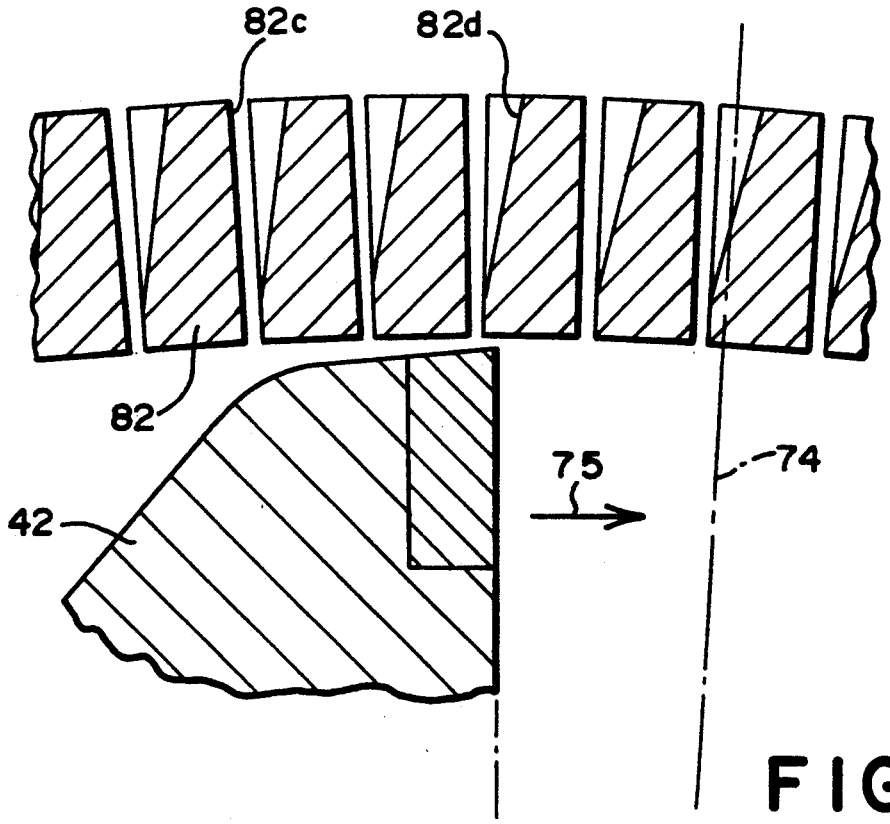
FIG. 21 is a partial, schematic view illustrating the impeller blade tip and the knives of FIG. 18 in a second orientation.

The knife 82 may be used in any of the knife orientations illustrated in FIGS. 10–15. FIG. 20 illustrates the preferred orientation of the knives 82, which is similar to that illustrated in FIG. 14. As can be seen, the angled side surface 82*d* provides increased clearance area between the adjacent knives in order to prevent the compacting of the milled material between the adjacent knives. In FIG. 20, the sides 82*c* of the knives face in the upstream direction relative to the blade 42 which is moving in the direction of arrow 75. When the upstream inner edges of the knives become worn, the knives may be changed to the orientation illustrated in FIG. 21 wherein the sides 82*c* face in the downstream direction. In this orientation, angled sides 82*d* still provide sufficient clearance between the adjacent knives to prevent the comminuted material from compacting in this space.

Comparison tests have been conducted between the comminuting mill of the present invention utilizing the knives illustrated in FIG. 5 and utilizing the knives illustrated in FIG. 18. In these tests, roasted peanut halves were milled at 11,000 pounds per hour with peanut oil being added. One hundred thirty pounds of peanuts were used in each test. Maximum particle sizes, as indicated by a Hegman gauge were the same. Milling the peanut halves with knives as illustrated in FIG. 5 required 150 horsepower and resulted in the temperature of the milled product being approximately 160° F. With the knives illustrated in FIG. 18, only 112 horsepower was required and the final temperature of the milled product was 135° F. Quite obviously, the use of the knives illustrated in FIG. 18 lowers the power required for the milling process and decreases the temperature of the milled product.

The foregoing description is provided for illustrative purposes only and should not be construed as in any way limiting this invention, the scope of which is defined solely by the appended claims.

I claim:

1. An impeller for use in a comminuting mill in which a product is comminuted by moving radially outwardly over a rotating impeller, comprising:

a) a generally circular impeller body rotatable about a rotational axis; and, b) a plurality of impeller blades attached to the impeller body, each of the impeller blades having a product directing surface extending parallel to and concavely curved about an axis extending in a generally chordal direction across the impeller body.

2. The impeller according to claim 1 wherein each product directing surface faces generally in the direction of rotation of the impeller body.

3. The impeller according to claim 1 wherein each impeller blade defines a generally radially inwardly facing product impact surface oriented such that contact with the product as the impeller rotates urges the product toward the center of the impeller.

4. The impeller according to claim 1 further comprising a hardened tip element attached to a radially outer portion of each impeller blade.

5. A mill for comminuting a product comprising:

a) an impeller rotatable about a rotational axis, comprising:

i) a generally circular impeller body; and, ii) a plurality of impeller blades attached to the impeller body, each impeller blade having a product directing surface extending parallel to and concavely cured about an axis extending in a generally chordal direction across the impeller body;

b) rotating means to rotate the impeller; and, c) feed means to feed the product onto the impeller near its rotational axis as it rotates such that the product is directed into contact with and between the impeller blades for comminuting the product.

6. The mill according to claim 5 wherein each product directing surface faces generally in the direction of rotation of the impeller body.

7. The mill according to claim 5 wherein each impeller blade defines a generally radially inwardly facing product impact surface.

8. The mill according to claim 7 wherein a portion of each product impact surface is convexly curved about an axis extending generally perpendicular to the impeller body.

9. The mill according to claim 5 further comprising a hardened tip element attached to a radially outer portion of each impeller blade.

10. The mill according to claim 5 wherein the rotating means rotates the impeller such that its peripheral speed is at least 400 ft/sec.

11. The mill according to claim 10 wherein the diameter of the impeller is at least ten inches.

12. The mill according to claim 5 wherein the feed means comprises a screw-type conveyor.

13. The mill according to claim 5 further comprising a plurality of circumferentially spaced apart knives located around the periphery of the impeller.

14. The mill according to claim 13 wherein each of the knives comprises:

a) an inner surface;

b) an outer surface;

c) a first side surface extending between the inner and outer surfaces; and, d) a second side surface wherein at least a portion of the second surface extends non-parallel to the first side surface such that a width of the outer surface is less than a width of the inner surface.

15. The mill according to claim 14 wherein the non-parallel portion of the second side surface is generally planar.

16. The mill according to claim 14 wherein the inner and outer surfaces are generally perpendicular to the first side surface.

17. A method of comminuting a product comprising the steps of:

a) rotating a generally circular impeller about a rotational axis;

b) feeding the product onto the rotating impeller;

c) impelling the product towards a plurality of stationary knives circumferntially spaced apart around the impeller over product directing surfaces of impeller blades, each product directing surface being concavely curved about an axis extending in a generally chordal direction of the impeller;

d) cutting the material with the stationary knives; and, e) passing the cut material through spaces defined between adjacent stationary knives.

18. The method according to claim 17 further comprising the additional step of impacting the product on a product impact surface on a generally radially inwardly facing portion of each impeller blade.

* * * * *